US008087649B2

(12) United States Patent
Duss et al.

(10) Patent No.: US 8,087,649 B2
(45) Date of Patent: Jan. 3, 2012

(54) ATTACHMENT DEVICE FOR A CLAMP AND COMBINATION OF A CLAMP AND AT LEAST ONE ATTACHMENT DEVICE

(75) Inventors: Michael Duss, Bietigheim-Bissingen (DE); Thomas Klein, Ottmarsheim (DE); Hans Roesch, Gemmrigheim (DE)

(73) Assignee: BESSEY Tool GmbH & Co. KG, Bietigheim-Bissingen (DE)

( * ) Notice: Subject to any disclaimer, the term of this patent is extended or adjusted under 35 U.S.C. 154(b) by 797 days.

(21) Appl. No.: 12/075,128

(22) Filed: Mar. 7, 2008

(65) Prior Publication Data

US 2009/0224453 A1 Sep. 10, 2009

(51) Int. Cl.
*B25B 5/00* (2006.01)

(52) U.S. Cl. ..... 269/249; 269/216; 269/240

(58) Field of Classification Search ..... 269/216, 269/240, 249

See application file for complete search history.

(56) References Cited

U.S. PATENT DOCUMENTS

| | | | | |
|---|---|---|---|---|
| 2,815,053 | A * | 12/1957 | Walker | 269/146 |
| 2,999,037 | A * | 9/1961 | Eberle | 269/142 |
| 4,105,344 | A * | 8/1978 | Rousom | 403/24 |
| 6,431,534 | B1 * | 8/2002 | Orosz et al. | 269/43 |
| 2003/0102614 | A1 | 6/2003 | Foshag et al. | |

OTHER PUBLICATIONS

Photograph of clamp , [online], [retrieved on Mar. 18, 2008]Retrieved from the BESSEY Tool website using Internet < URL: http://www.bessey.de/media/webbilder/00008097_0.jpg >.

* cited by examiner

*Primary Examiner* — Joseph J Hail
*Assistant Examiner* — Shantese McDonald
(74) *Attorney, Agent, or Firm* — Lipsitz & McAllister, LLC

(57) ABSTRACT

Attachment device for a clamp, said clamp having at least one clamp contact member for workpieces, said attachment device comprising a fixing member for fixing the attachment device in a releasable manner to the at least one clamp contact member, an attachment device contact member for contacting workpieces, which is held on the fixing member, and a pivot bearing via which the attachment device contact member is pivotable with regard to the fixing member.

23 Claims, 5 Drawing Sheets

5
5
110
16
18
20
52
100
108
112
D
106
114
98
116
56a
54
94
102
104
56b
80
76
72
78
70
74
58
62
64
88
86b
84
92
82
86a
90
86
60
66
68

ATTACHMENT DEVICE FOR A CLAMP AND COMBINATION OF A CLAMP AND AT LEAST ONE ATTACHMENT DEVICE

BACKGROUND OF THE INVENTION

The present invention relates to an attachment device for a clamp.

Further, the present invention is related to a combination of a clamp and at least one attachment device.

Clamps with parallel workpiece contact surfaces are described, for example, in US 2003/0102614 A1 or in the non-published German patent application No. 10 2007 039 141.9 of Aug. 16, 2007.

SUMMARY OF THE INVENTION

In an embodiment of the present invention, an attachment device for a clamp is provided, said clamp having at least one clamp contact member for workpieces, said attachment device comprising a fixing member for fixing the attachment device in a releasable manner to the at least one clamp contact member, an attachment device contact member for contacting workpieces, which is held on the fixing member, and a pivot bearing via which the attachment device contact member is pivotable with regard to the fixing member.

With such an attachment device, the possibilities of a clamp for operative use can be extended. Via the attachment device it is possible to adjust a workpiece contact surface to a broader variety of workpieces. In particular, workpieces with inclined surfaces can be clamped in a simple manner.

Further, with the attachment device in accordance with the present invention, it is possible to enlarge the workpiece contact surface at least in one direction and thereby increasing the variability of use.

Moreover, since the attachment device in accordance with the present invention can be releasably fixed to the clamp, the clamp without the attachment device can be used in a "normal way".

The attachment device in accordance with the present invention can be manufactured in a simple way. In particular, the fixing member and the attachment device contact member can be made of a plastics material.

It is advantageous when a pivot axis of the pivot bearing is at least approximately parallel to a workpiece contact surface of the at least one clamp contact member. Such, it is possible to adjust the inclination of the workpiece contact surface of the attachment device.

In particular, a pivot axis of the pivot bearing lies on a workpiece contact surface of the attachment device contact member. Such, forces exerted via the clamping of workpieces can be guided away in an effective manner with a minimum of wear of the pivot bearing.

It is advantageous when a contact surface of the attachment device contact member has its largest extension in direction transverse to a pivot axis of the pivot bearing. Thereby, a workpiece contact surface area provided by the attachment device can be laterally extended compared to a clamp contact member.

In particular, a workpiece contact surface of the attachment device contact member has its largest extension in direction transverse to a direction in which a workpiece contact surface area of the clamp contact member has its largest extension. This allows, via the use of at least one attachment device, a broader variability for the clamping of workpieces.

For the same reasons it is advantageous when a workpiece contact surface of the attachment device contact member has a larger width than the at least one clamp contact member and in particular protrude laterally beyond the at least one clamp contact member.

It is advantageous when the fixing member comprises at least one cylindrical guiding track on which the attachment device contact member is slideable. Such, a large contact area between the fixing member and the attachment device contact member is provided. This allows an effective guiding away from forces exerted via the clamping of workpieces. This, in particular, allows that the fixing member and the attachment device contact member can be made of a plastics material.

For the same reasons it is advantageous when the attachment device contact member comprises at least one hollow cylindrical guiding track for sliding on the fixing member. Via this hollow cylindrical guiding track (which can be a closed surface or a guiding track with a hollow cylindrical envelope surface) forces can be effectively transferred to the fixing member and from there to the clamp contact member.

In a particular advantageous embodiment, the fixing member comprises a push-in connector via which the attachment device is pushable on the at least one clamp contact member. Such, an attachment device can be fixed in any height on a respective clamp contact member. The push-in connector allows a releasable mounting in a simple manner.

In one embodiment, the fixing member comprises opposite ledges for being held by the at least one clamp contact member. Via the ledges, the fixing member can partially surround the clamp contact member and thereby being mounted on the clamp contact member.

In particular, at least one of the ledges is formed in such a way that the distance between the opposite ledges decreases in a direction away from the fixing member. Such, the fixing member can be "clamped" on a clamp contact member.

If at least one of the ledges provides undercut surfaces for being held on the at least one clamp contact member, the releasable mounting of an attachment device on a clamp contact member can be performed in a simple manner.

Further, it is advantageous when the fixing member comprises a contact surface for a workpiece contact surface of the at least one clamp contact member. Such, a large contact area between the clamp contact member and the attachment device is provided. This allows an effective guiding away of forces from the attachment device into the clamp contact member. Such, the demands on the mechanical stability of the attachment device can be reduced. For example, the attachment device can be made of a plastics material.

In particular, the fixing member contact surface is a plane surface providing a large contact area.

Further, in accordance with an embodiment of the present invention, an attachment device is provided with a—pivotable or non-pivotable—workpiece contact surface of the attachment device contact member having a larger width than a workpiece contact surface of the at least one clamp contact member.

In particular, the width of the workpiece contact surface of the attachment device contact member is at least twice as large as the width of the workpiece contact surface of the at least one clamp contact member.

Such, the workpiece contact surface of a clamp contact member provided with an attachment device in accordance with the present invention can be enlarged. The corresponding clamp has then a broader variability of use.

In an embodiment of the present invention, a combination of a clamp and at least one attachment device is provided.

A clamp contact member which can be provided with an attachment device can be slideable with regard to a slide rail, permanently fixed on the slide rail or releasably fixed on the slide rail.

It is advantageous when a clamp contact member comprises an attachment portion projecting beyond an adjacent portion for providing an attachment area for the attaching device. In particular, the attachment device can be pushed-in on the attachment portion via ledges and is held there via these ledges.

The following description of preferred embodiments serves in connection with the drawings to provide a detailed explanation of the invention.

DETAILED DESCRIPTION OF THE INVENTION

The attachment device in accordance with the present invention can be advantageously used with a body clamp as described, for example, in US 2003/0102614 A1 or in non-published German patent application No. 10 2007 039 841.9 of Aug. 16, 2007.

Figure 1:
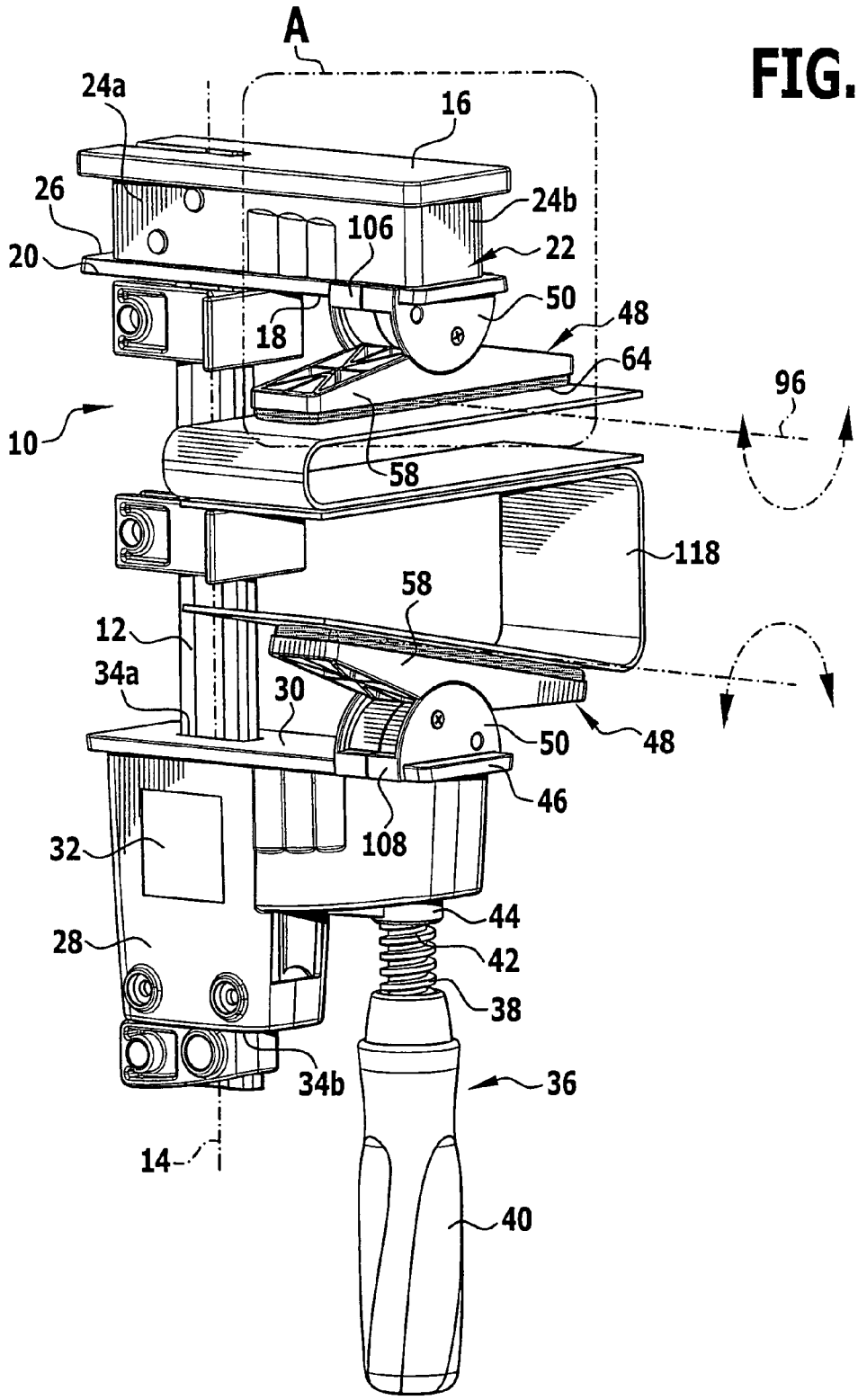
FIG. 1 shows a perspective view of an embodiment of a clamp with fixed attachment devices in accordance with the present invention.

A body clamp, of which an embodiment is shown in FIG. 1 and designated there as 10, comprises a slide rail 12 preferably made of a metallic material. The slide rail 12 extends in a linear direction 14. On the slide rail 12 is fixed a first clamp contact member 16. This first clamp contact member 16 can be fixed in a permanent manner or in a releasable manner in such a way that its position on the slide rail 12 is adjustable.

The first clamp contact member 16 has a workpiece contact surface area 18 which is oriented transverse to the direction 14 and in particular oriented perpendicular to the slide rail 12.

The workpiece contact surface 18 is formed on an attachment portion 20 which is of a plate-like structure. The first clamp contact member 16 has a box-like housing 22 with housing walls 24*a*, 24*b*. The attachment portion 20 protrudes beyond the housing walls 24*a*, 24*b* in such a way that the housing walls 24*a*, 24*b* are set back with regard to a rear side 26 of the attachment portion 20. The rear side 26 is opposite to the workpiece contact surface 18.

The body clamp 10 further comprises a second clamp contact member 28. This second clamp contact member 28 comprises a workpiece contact surface 30 which is transverse and in particular perpendicular to the direction 14 of the slide rail 12. In particular, the workpiece contact surface 30 is parallel to the workpiece contact surface 18 of the first clamp contact member 16.

The second clamp contact member 28 has a housing 32 with a first opening 34*a* and a second opening 34*b* aligned to the first opening 34*a*. The slide rail 12 is guided through the first opening 34*a* and the second opening 34*b*.

The second clamp contact member 28 is held in a slideable manner on the slide rail 12. The position of the second clamp contact member 28 with regard to the first clamp contact member 16 can be adjusted.

A pressure application device 36 cooperates with the second clamp contact member 28. The pressure application device 36 comprises a threaded spindle 38 on which a handle 40 is seated. The threaded spindle 38 sits in a thread 42 that is held on an arm 44 which is seated in a slideable manner on the slide rail 12 at least partially within the housing 32. Via the pressure application device 36 it is possible to apply a pressure force on a workpiece held between the first clamp contact member 16 and the second clamp contact member 28. As to details related to the pressure application device 36 and its connection to the housing 32, reference is made to US 2003/0102614 A1 and the unpublished German patent application No. 10 2007 039 841.9 of Aug. 16, 2007.

The workpiece contact surface 30 of the second clamp contact member 28 is formed on an attachment portion 46 which overlaps the housing 32 in a similar manner as the workpiece contact area 20 overlaps the housing 22.

One or several workpieces can be clamped between the first clamp contact member 16 and the second clamp contact member 28. For that, the second clamp contact member 28 is pushed towards the first clamp contact member 16 until the workpiece contact surface 30 touches the corresponding workpiece. Via the pressure application device 36 a pressure force can be applied to the workpiece for exerting a pressure force in the direction of the workpiece contact surface 18.

In accordance with the present invention, an attachment device 48, of which embodiments are shown in FIGS. 1 to 5, is provided for extending the possibilities of use of the clamp 10.

One or several attachment devices 48 can be attached to at least one of the first clamp contact member 16 and the second clamp contact member 28. FIG. 1 shows an embodiment with attachment devices 48 fixed both on the first clamp contact member 16 and the second clamp contact member 28.

An attachment device in accordance with the present invention comprises (FIGS. 3 to 5) a fixing member 50 for fixing the attachment device 48 to the first clamp contact member 16 or second clamp contact member 28. The fixing device consists, for example, of a first part 52 and a second part 54 (FIG. 4) which are set together.

The first part 52 and second part 54 are held together by screws 56*a*, 56*b*.

The fixing member 50 pivotably holds an attachment device contact member 58. This attachment device contact member 58 comprises a holder 60 held by the fixing member 50. The holder 60 itself holds an element 62 which comprises a workpiece contact surface 64. The workpiece contact surface 64 can be formed on the holder 60 without an additional element 62.

The workpiece contact surface 64 is basically a rectangle extending in a first direction 66 and a second direction 68 perpendicular to the first direction 66. The extension of the workpiece contact surface 64 in the first direction 66 is larger than in the second direction 68.

The fixing member 50 with the first part 52 and the second part 54 is formed in such a way that the attachment device contact member 58 is held on the fixing member 50 in a way that prevents falling off and allows a pivotable movement of the attachment device contact member 58 with regard to the fixing member 50 (and thereby with regard to the respective clamp contact member 16 or 28).

For this, the fixing member 50 has oriented towards the holder 60 a cylindrical outer shape 70 defining a guiding track 72 for the holder 60. The guiding track 72 is formed both on the first part 52 and the second part 54.

The first part 52 has a rim 74 extending above the cylindrical outer shape 70. In a similar way, the second part 54 has a rim 76 extending above the guiding track 72. The rims 74, 76 have a circular ring shape.

The rims 74, 76 have ring shaped recesses 78, 80, respectively.

The holder 60 of the attachment device contact member 58 comprises a guiding track 82 of hollow cylindrical shape adapted to the guiding track 72. With said guiding track 82, the attachment device contact member 58 sits on the fixing member 50.

Figure 4:
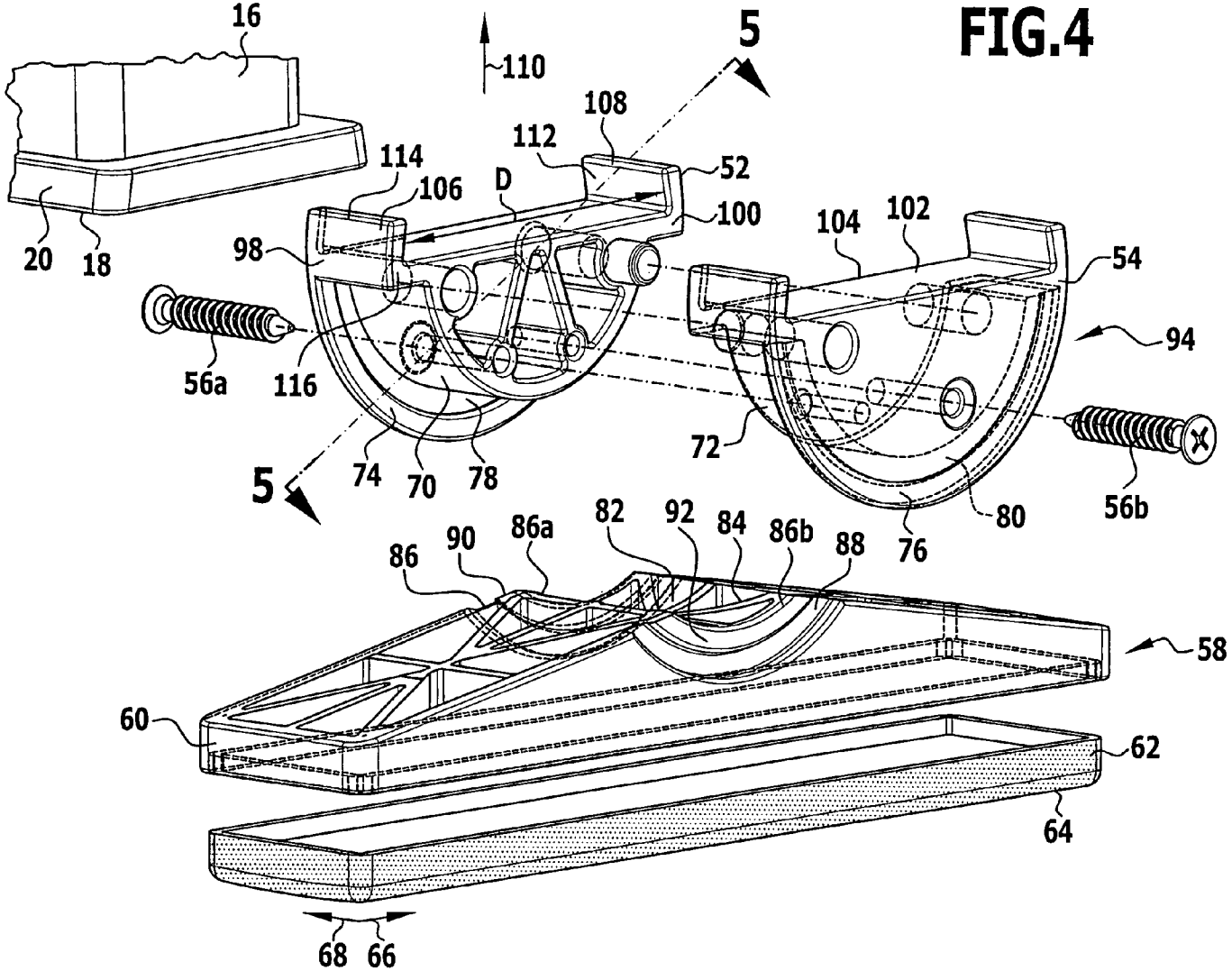
FIG. 4 shows an exploded view of an embodiment of an attachment device.
Figure 5:
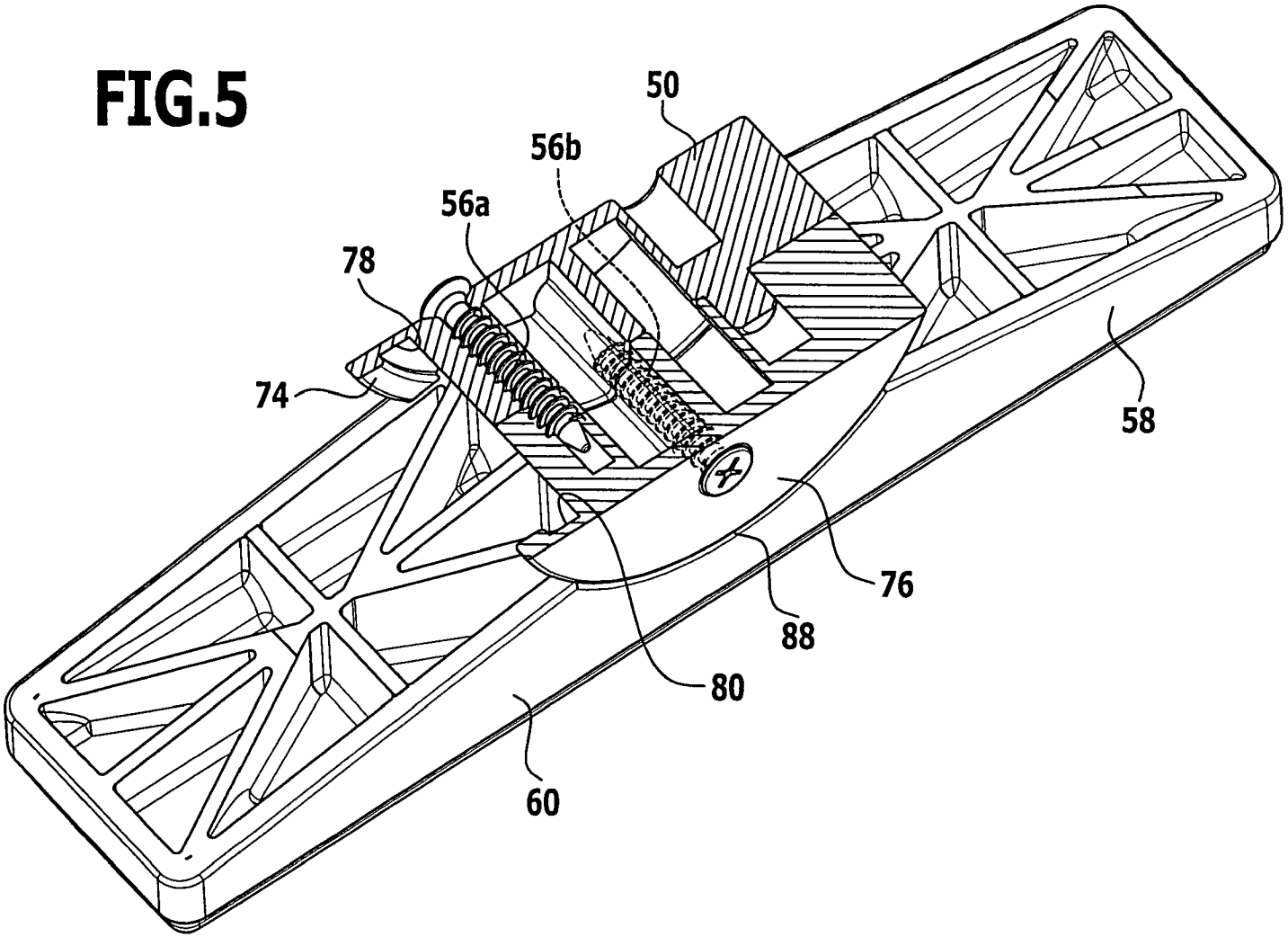
FIG. 5 shows a sectional view of the attachment device of FIG. 4 along the line 5-5.

The guiding track 82 can be formed by a closed surface or, as shown in FIG. 4, for example via bridge elements 84 having the hollow cylindrical guiding track 84 as envelope surface. The bridge elements 84 are, in particular, arranged in a star-shaped manner with outer bridges 86*a*, 86*b*. These bridge elements 84 increase the stability of the holder 60 with increasing the weight at a minimum.

The holder 60 has adjacent to the guiding track 82 on its outer side opposite recesses 86, 88 adapted in its shape to the rims 74 and 76. The recesses 86, 88 have a circular ring-shaped structure.

In these recesses 86, 88 a raised circular-shaped ring element 90, 92 is disposed, respectively. These ring elements 90, 92 are adapted to the recesses 78, 80. The ring element 90 is positioned in the recess 78 and the ring element 92 is positioned in the recess 80. If the first part 52 and the second part 54 are mounted for forming the fixing member 50, the holder 60 sits with its guiding track 82 on the guiding track 72 of the fixing member 50. The rim 74 sits in the recess 86 and the rim 76 sits in the recess 88. The ring element 90 is disposed in the recess 78 and the ring element 92 is disposed in the recess 78. Such, the holder 60 cannot be detached from the fixing member 50 but a pivotable movement of the attachment device contact member 58 on the fixing member 50 is possible.

Via the guiding tracks 72 and 82, a sliding movement of the holder 60 on the fixing member 50 is possible. The surface area via which the holder 60 mechanically contacts the fixing member 50 is large so that forces exerted on the attachment device contact member 58 can be guided away in an effective manner through the fixing member 50.

Via the guiding tracks 72 and 82 a pivot bearing 94 is formed. A pivot axis 96 (FIG. 3) lies in front of the fixing member 50. In an advantageous embodiment, the pivot axis 96 lies on the workpiece contact surface 64.

The fixing member 50 comprises elements 98, 100 bridging between the rims 74 and 78 and thereby forming a boundary for the guiding track 72. The bridging elements 98, 100 define contact surfaces for the holder 60 and thereby limiting the angle range in which the attachment device contact member 58 is pivotable with regard to the fixing member 50.

In particular, the angular range for the pivotal movement lies between at most −30° and +30°. In one embodiment, the range lies between approximately −15° and +15°.

The fixing member 50 has a side 102 from which outgoing the rims 74 and 76 extend. This side 102 comprises an essentially plane contact surface 104. Via this contact surface 104 the attachment device 48 contacts a corresponding workpiece contact surface of a clamp contact member when attached to the clamp contact member.

Extending from this plain contact surface 104 are opposite ledges 106, 108. A distance D between these ledges 106, 108 decreases in a direction 110 outwardly away from the fixing member 50. Such, the ledges 106, 108 have a cross-section with varying width. A side 112 of the ledges 106, 108 which faces the other ledge 108 or 106, is inclined with regard to the contact surface 104 in such a way that an outer end 140 of the ledges 106, 108, respectively, has a larger width than a portion 116 of the respective ledge 106, 108, via which this ledge 106, 108 is attached to the contact surface 104.

The fixing member 50 can be pushed on the corresponding attachment portion 20 of the respective clamp contact member. Via the ledges 106, 108 an undercut section is provided. A connector is formed that allows a releasable connection of the attachment device 48 to a clamp contact member via pushing the fixing member 50 onto an attachment portion 20 and the ledges 106, 108 with their sides 112 define stop faces that prevent a movement of the attachment device 48 in a direction perpendicular to the corresponding workpiece contact surface 18 of the respective clamp contact member. With the ledges 106, 108, the attachment device 48 can be clamped on a clamp contact device.

Via the plane or flat contact surface 104, forces exerted on the attachment device 48 can effectively guided into the corresponding clamp contact member 16 or 28.

The fixing member 50 and attachment device contact member 58 are preferably made of a plastics material. The cylindrical shapes of the guiding tracks 72 and 82 and the contact surface 104 guarantee an effective guiding away of forces from the attachment device. Therefore, a plastics material is useable for the attachment device.

When an attachment device 48 is fixed on a corresponding clamp contact member 16 or 28, the pivot axis 96 of the respective attachment device 48 is essentially parallel to the corresponding workpiece contact surface 18 of the corresponding clamp contact member 16.

Via the push-in connector formed on the fixing member 50, an attachment device 48 can be positioned (in a releasable manner) in any height with regard to the slide rail 12 on the respective clamp contact member 16 or 28.

Figure 2:
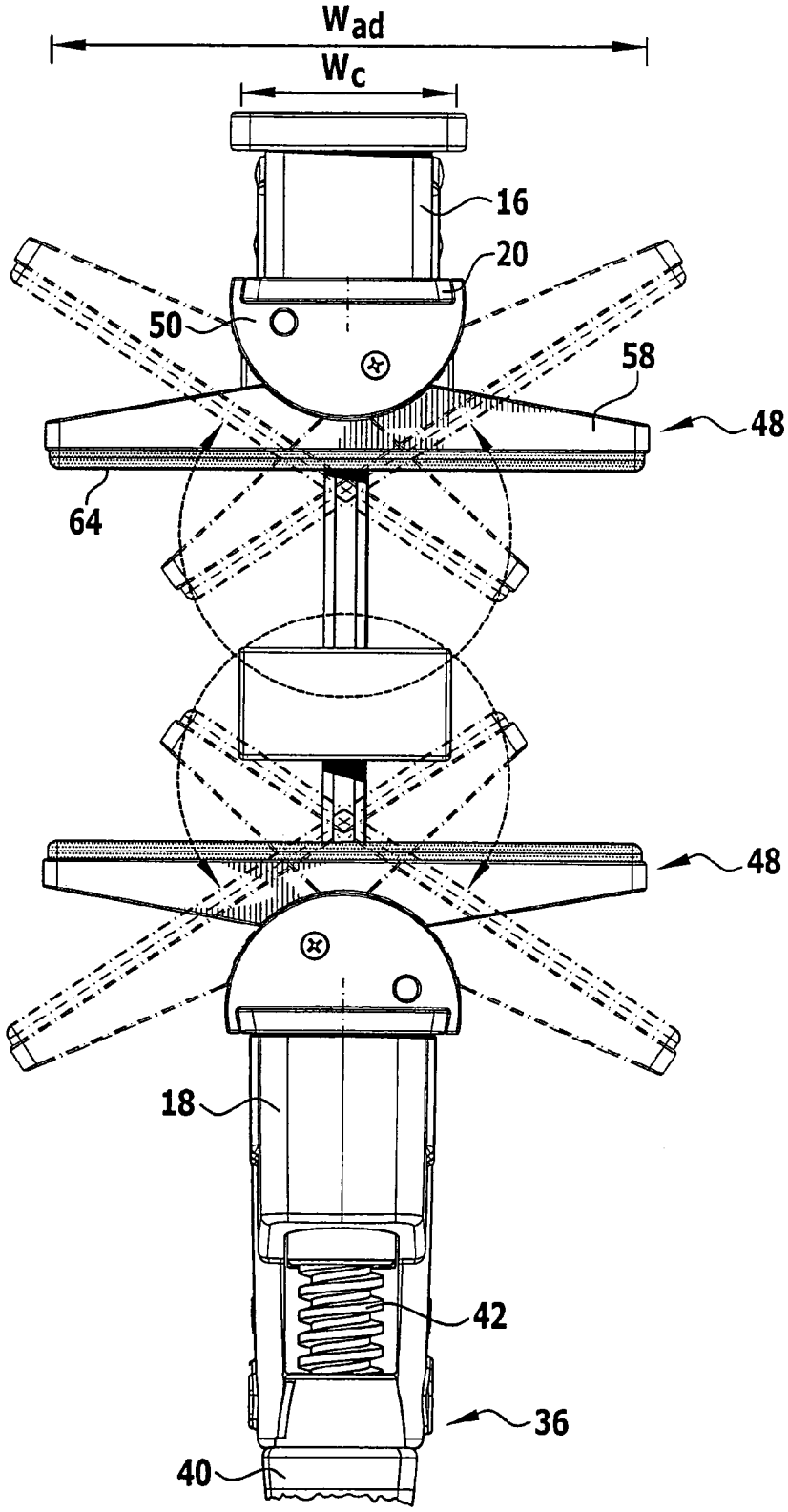
FIG. 2 shows a top view of the clamp attachment device combination of FIG. 1.
Figure 3:
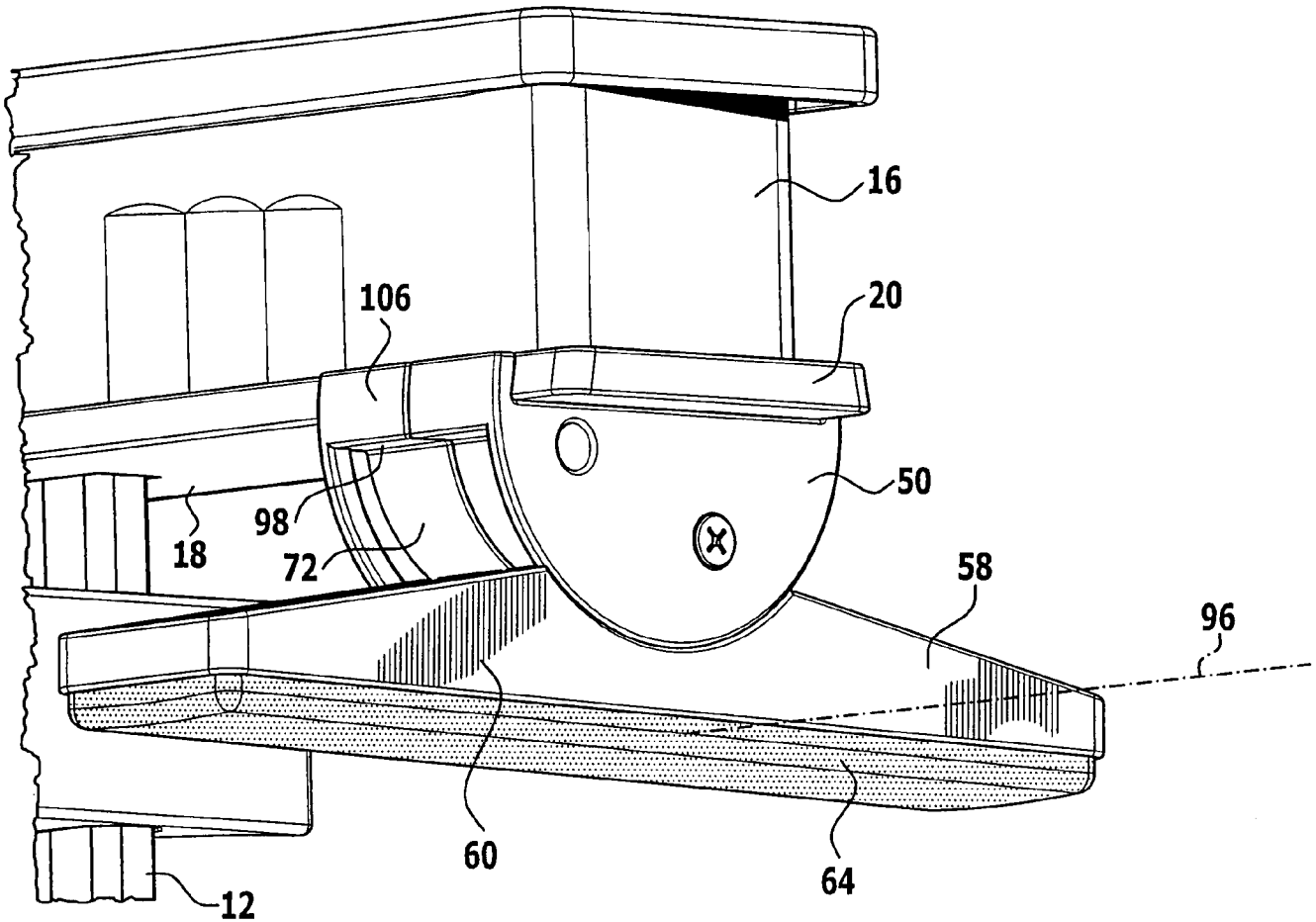
FIG. 3 shows an enlarged view of the area A in FIG. 1.

The workpiece contact surface 64 of the attachment device 48 has a width $W_{ad}$ (FIG. 2). This width $W_{ad}$ is larger than a corresponding width $W_c$ of the workpiece contact surface 18 or 30 of the first clamp contact member 16 or second clamp contact member 28. Such, via use of an attachment device 48, the workpiece contact surface width of the clamp 10 can be extended.

An attachment device 48 function as follows:

Via the ledges 106, 108 of the fixing member 50 an attachment device 48 is pushed onto the clamp contact member on which it is to be fixed. The attachment device clamp combination as shown in FIG. 1 comprises attachment device 48 fixed both on the first clamp contact member 16 and second clamp contact member 28.

The ledges 106, 108 form a push-in connector via which a corresponding attachment device 48 can be positioned in any height on the corresponding clamp contact member. In one embodiment, the attachment portion 20 is formed with a material which is slightly elastic to allow easy fixing of an attachment device 48.

Via an attachment device 48 a workpiece contact surface 64 is provided, which lies in front (in a viewing direction towards the other clamp contact member) of the respective clamp contact member. The workpiece contact surface 64 has a larger width than the corresponding workpiece contact surface 18 of the respective clamp member. The workpiece contact surface 64 of the attachment device 48 extends laterally beyond the respective clamp member, on which it is held. This provides further clamping possibilities.

Moreover, the workpiece contact surface 84 of the attachment device 48 is pivotable via the pivot bearing 94 with regard to the corresponding clamp contact member, on which the attachment device 48 is held. Such, workpieces with inclined faces can be clamped, too. An example of such a workpiece is shown in FIG. 1 and designated there with 118.

The attachment device 48 in accordance with the present invention allows increased usability for the clamp 10. It is possible to clamp a higher variety of workpieces between the first clamp contact member 16 and the second clamp contact member 28.

The invention claimed is:

1. Attachment device for a clamp, said clamp having at least one clamp contact member for workpieces, said attachment device comprising:

a fixing member for fixing the attachment device in a releasable manner to the at least one clamp contact member;

an attachment device contact member for contacting workpieces, which is held on the fixing member; and a pivot bearing via which the attachment device contact member is pivotable with regard to the fixing member;

wherein:

the fixing member comprises at least one cylindrical guide rim on which the attachment device contact member is slideable;

the attachment device contact member comprises at least one cylindrical guide recess for sliding on the cylindrical guide rim of the fixing member;

a pivot axis of a workpiece contact surface of the attachment device contact member is at least approximately parallel to a workpiece contact surface of the at least one clamp contact member; and the pivot axis lies on the workpiece contact surface of the attachment device contact member.

2. Attachment device in accordance with claim 1, wherein the workpiece contact surface of the attachment device contact member has its largest extension in a direction transverse to the pivot axis.

3. Attachment device in accordance with claim 1, wherein the workpiece contact surface of the attachment device contact member has its largest extension in a direction transverse to a direction, in which the workpiece contact surface area of the at least one clamp contact member has its largest extension.

4. Attachment device in accordance with claim 1, wherein the workpiece contact surface of the attachment device contact member has a larger width than the at least one clamp contact member.

5. Attachment device in accordance with claim 4, wherein the workpiece contact surface of the attachment device contact member protrudes laterally beyond the at least one clamp contact member.

6. Attachment device in accordance with claim 4, wherein the width of the workpiece contact surface of the attachment device contact member is at least twice as large as the width of the workpiece contact surface of the at least one clamp contact member.

7. Attachment device in accordance with claim 1, wherein the attachment device is pivotable in an angle range between at most −30° and +30°.

8. Attachment device in accordance with claim 1, wherein the fixing member comprises a push-in connector via which the attachment device is pushable on the at least one clamp contact member.

9. Attachment device in accordance with claim 8, wherein the fixing member comprises opposite ledges for being held by the at least one clamp contact member.

10. Attachment device in accordance with claim 1, wherein the fixing member comprises a contact surface for the workpiece contact surface of the at least one clamp contact member.

11. Attachment device in accordance with claim 10, wherein the fixing member contact surface is a plain surface.

12. Attachment device in accordance with claim 1, wherein the fixing member and attachment device contact member are made of plastics material.

13. Attachment device for a clamp, said clamp having at least one clamp contact member for workpieces, said attachment device comprising:

a fixing member for fixing the attachment device in a releasable manner to the at least one clamp contact member;

an attachment device contact member for contacting workpieces, which is held on the fixing member; and a pivot bearing via which the attachment device contact member is pivotable with regard to the fixing member;

wherein:

the fixing member comprises at least one cylindrical guide rim on which the attachment device contact member is slideable;

the attachment device contact member comprises at least one cylindrical guide recess for sliding on the cylindrical guide rim of the fixing member;

the fixing member comprises a push-in connector via which the attachment device is pushable on the at least one clamp contact member;

the fixing member comprises opposite ledges for being held by the at least one clamp contact member; and at least one of the ledges is formed in such a way that a distance between the opposite ledges decreases in a direction away from the fixing member.

14. Attachment device in accordance with claim 13, wherein at least one of the ledges provides undercut surfaces for being held on the at least one clamp contact member.

15. Attachment device in accordance with claim 13, wherein:

a pivot axis of a workpiece contact surface of the attachment device contact member is at least approximately parallel to a workpiece contact surface of the at least one clamp contact member; and the pivot axis lies on the workpiece contact surface of the attachment device contact member.

16. A combination of a clamp and at least one attachment device, said clamp comprising:

a slide rail;

a first clamp contact member fixed on the slide rail; and a second clamp contact member moveable on the slide rail;

said at least one attachment device comprising:

a fixing member for releasably fixing the attachment device to at least one of the first clamp contact member and the second clamp contact member;

an attachment device contact member held by the fixing member and having a contact surface for workpieces with a larger width than a workpiece contact surface of at least one of the first clamp contact member and the second clamp contact member; and a pivot bearing via which the attachment device contact member is pivotable with regard to the fixing member;

wherein:

the fixing member comprises at least one cylindrical guide rim on which the attachment device contact member is slideable;

the attachment device contact member comprises at least one cylindrical guide recess for sliding on the cylindrical guide rim of the fixing member;

a pivot axis of a workpiece contact surface of the attachment device contact member is at least approximately parallel to a workpiece contact surface of the first clamp contact member when the attachment device is fixed to the first clamp contact member, or is at least approximately parallel to a workpiece contact surface of the second clamp contact member when the attachment device is fixed to the second clamp contact member; and the pivot axis lies on the workpiece contact surface of the attachment device contact member.

17. Attachment device in accordance with claim 16, wherein at least one of the first clamp contact member and the second clamp contact member has a box-like housing.

18. Attachment device in accordance with claim 16, wherein at least one of the first clamp contact member and the second clamp contact member comprises an attachment portion projecting beyond an adjacent portion for providing an attachment area for said at least one attachment device.

19. Attachment device in accordance with claim 18, wherein a thickness of the attachment portion is adapted to ledges of the fixing member for releasably fixing said at least one attachment device.

20. Attachment device for a clamp, said clamp having at least one clamp contact member for workpieces, said attachment device comprising:

a fixing member for fixing the attachment device in a releasable manner to the at least one clamp contact member;

an attachment device contact member for contacting workpieces, which is held on the fixing member; and a pivot bearing via which the attachment device contact member is pivotable with regard to the fixing member;

wherein:

the fixing member comprises a push-in connector via which the attachment device is pushable on the at least one clamp contact member;

the fixing member comprises opposite ledges for being held by the at least one clamp contact member, and at least one of the ledges is formed in such a way that a distance between the opposite ledges decreases in a direction away from the fixing member.

21. Attachment device in accordance with claim 20, wherein a pivot axis of a workpiece contact surface of the attachment device contact member is at least approximately parallel to a workpiece contact surface of the at least one clamp contact member.

22. Attachment device in accordance with claim 21, wherein the pivot axis lies on the workpiece contact surface of the attachment device contact member.

23. Attachment device in accordance with claim 20, wherein at least one of the ledges provides undercut surfaces for being held on the at least one clamp contact member.

* * * * *